US011821625B2

(12) United States Patent
Diloyan et al.

(10) Patent No.: US 11,821,625 B2
(45) Date of Patent: Nov. 21, 2023

(54) SYSTEMS AND APPARATUSES FOR EFFICIENTLY BURNING FUELS

(71) Applicant: Temple University of the Commonwealth System of Higher Education, Philadelphia, PA (US)

(72) Inventors: Oleksandr Diloyan, Philadelphia, PA (US); Haykazuni Andreasyan, Huntington Valley, PA (US)

(73) Assignee: Temple University of the Commonwealth System of Higher Education, Philadelphia, PA (US)

( * ) Notice: Subject to any disclaimer, the term of this patent is extended or adjusted under 35 U.S.C. 154(b) by 755 days.

(21) Appl. No.: 16/626,633

(22) PCT Filed: Jun. 25, 2018

(86) PCT No.: PCT/US2018/039287
§ 371 (c)(1),
(2) Date: Dec. 26, 2019

(87) PCT Pub. No.: WO2019/005672
PCT Pub. Date: Jan. 3, 2019

(65) Prior Publication Data

US 2020/0124275 A1 Apr. 23, 2020

Related U.S. Application Data

(60) Provisional application No. 62/524,797, filed on Jun. 26, 2017.

(51) Int. Cl.

| | |
|---|---|
| ***F23C 99/00*** | (2006.01) |
| ***F02M 27/04*** | (2006.01) |
| ***F23K 5/08*** | (2006.01) |

(52) U.S. Cl.
CPC ..... *F23C 99/001* (2013.01); *F02M 27/045* (2013.01); *F23K 5/08* (2013.01)

(58) Field of Classification Search
CPC ..... F23C 99/001; F02M 27/045; F23K 5/08
(Continued)

(56) References Cited

U.S. PATENT DOCUMENTS 3,059,910 A * 10/1962 Saburo ..... F02M 27/04 313/231.01
7,351,337 B1 * 4/2008 Milo ..... F02M 27/045 210/695

FOREIGN PATENT DOCUMENTS

RU 2115010 C1 7/1998
RU 2121068 C1 10/1998
(Continued)

OTHER PUBLICATIONS

International Preliminary Report on Patentability for International Application No. PCT/US2018/039287, dated Dec. 31, 2019, 6 pages.

(Continued)

*Primary Examiner* — Phutthiwat Wongwian
*Assistant Examiner* — Omar Morales
(74) *Attorney, Agent, or Firm* — RatnerPrestia

(57) ABSTRACT

Aspects of the invention are directed to systems and apparatuses for efficiently burning fuels. According to one aspect of the invention, apparatus for efficiently burning hydrocarbons includes a housing having a first opening for receiving a fuel, a second opening for expelling the fuel, and a tubular passageway extending between the first opening and the second opening. The tubular passageway includes a central region and an outer region surrounding the central region. The apparatus also includes a plurality of magnets disposed within the passageway. Each of the magnets has a spherical
(Continued)

or an ovoid shape. The plurality of magnets define void spaces for passing the fuel such that a central flow rate of the fuel in the central region of the passageway is equivalent to the an outer flow rate of the fuel in an outer region of the passageway.

9 Claims, 6 Drawing Sheets

(58) Field of Classification Search
USPC ..... 431/253
See application file for complete search history.

(56) References Cited

FOREIGN PATENT DOCUMENTS

| | | | |
|---|---|---|---|
| RU | 67654 | U1 | 10/2007 |
| SU | 1388573 | A1 * | 4/1988 |
| SU | 1388573 | A1 | 4/1988 |
| WO | 2005054658 | A1 | 6/2005 |

OTHER PUBLICATIONS

International Search Report and Written Opinion for International Application No. PCT/US2018/039287, dated Oct. 18, 2018, 6 pages.

* cited by examiner

SYSTEMS AND APPARATUSES FOR EFFICIENTLY BURNING FUELS

This application is a U.S. National Phase Application of PCT International Application PCT/US2018/039287, filed Jun. 25, 2018, and claims the benefit of priority to, U.S. Provisional Application No. 62/524,797, entitled SYSTEMS AND APPARATUSES FOR EFFICIENTLY BURNING FUELS, filed on 26 Jun. 2017, the contents of which are incorporated herein by reference in their entirety for all purposes.

FIELD OF THE INVENTION

The invention is directed to systems and apparatuses For efficiently burning fuels and, particularly, to systems and apparatuses using magnetic fields to efficiently burn hydrocarbons.

BACKGROUND OF THE INVENTION

Hydrocarbons, such as natural gas and oil, have been used as a fuel for hundreds of years. For example, natural gas was used commercially in the late 1700s in Great Britain and the early 1800s in the United States as a fuel for street lights. Over time various devices have been developed for utilizing hydrocarbons as a fuel.

In recent years, concerns over global warming as well as the price of hydrocarbons, has led to a need for devices that utilize less hydrocarbons as fuel. Additionally, there is a long-standing need for apparatuses and systems that improve the combustion efficiency of hydrocarbon fuels.

SUMMARY OF THE INVENTION

Aspects of the invention are directed to systems and apparatuses for efficiently burning fuels.

According to one aspect of the invention, an apparatus for efficiently burning hydrocarbons includes a housing having a first opening for receiving a fuel, a second opening for expelling the fuel, and a tubular passageway extending between the first opening and the second opening. The tubular passageway includes a central region and an outer region surrounding the central region. The apparatus also includes a plurality of magnets disposed within the passageway. Each of the magnets has a spherical or an ovoid shape. The plurality of magnets define void spaces for passing the fuel such that a central flow rate of the fuel in the central region of the passageway is equivalent to the an outer flow rate of the fuel in an outer region of the passageway.

In accordance with another aspects of the invention, an apparatus for efficiently burning hydrocarbons includes a housing having a first end portion defining a first opening for receiving a fuel, a second end portion defining a second opening for expelling the fuel, and a tubular passageway extending between the first opening and the second opening. The apparatus also includes a plurality of magnets disposed within at least one of the first end portion and the second end portion. Each of the magnets has one of a spherical or an ovoid shape. In addition, the apparatus includes at least a first magnetic plate positioned proximal to a first side of the housing and a second magnetic plate positioned proximal to a second side of the housing and opposed the first magnetic plate.

BRIEF DESCRIPTION OF THE DRAWINGS

The invention is best understood from the following detailed description when read in connection with the accompanying drawings, with like elements having the same reference numerals. It is emphasized that according to common practice the various features of the drawings are not drawn to scale unless otherwise indicated. On the contrary, the dimensions of the various features may be expanded or reduced for clarity. Included in the drawings are the following figures.

DETAILED DESCRIPTION OF EMBODIMENTS OF THE INVENTION

Figure 1:
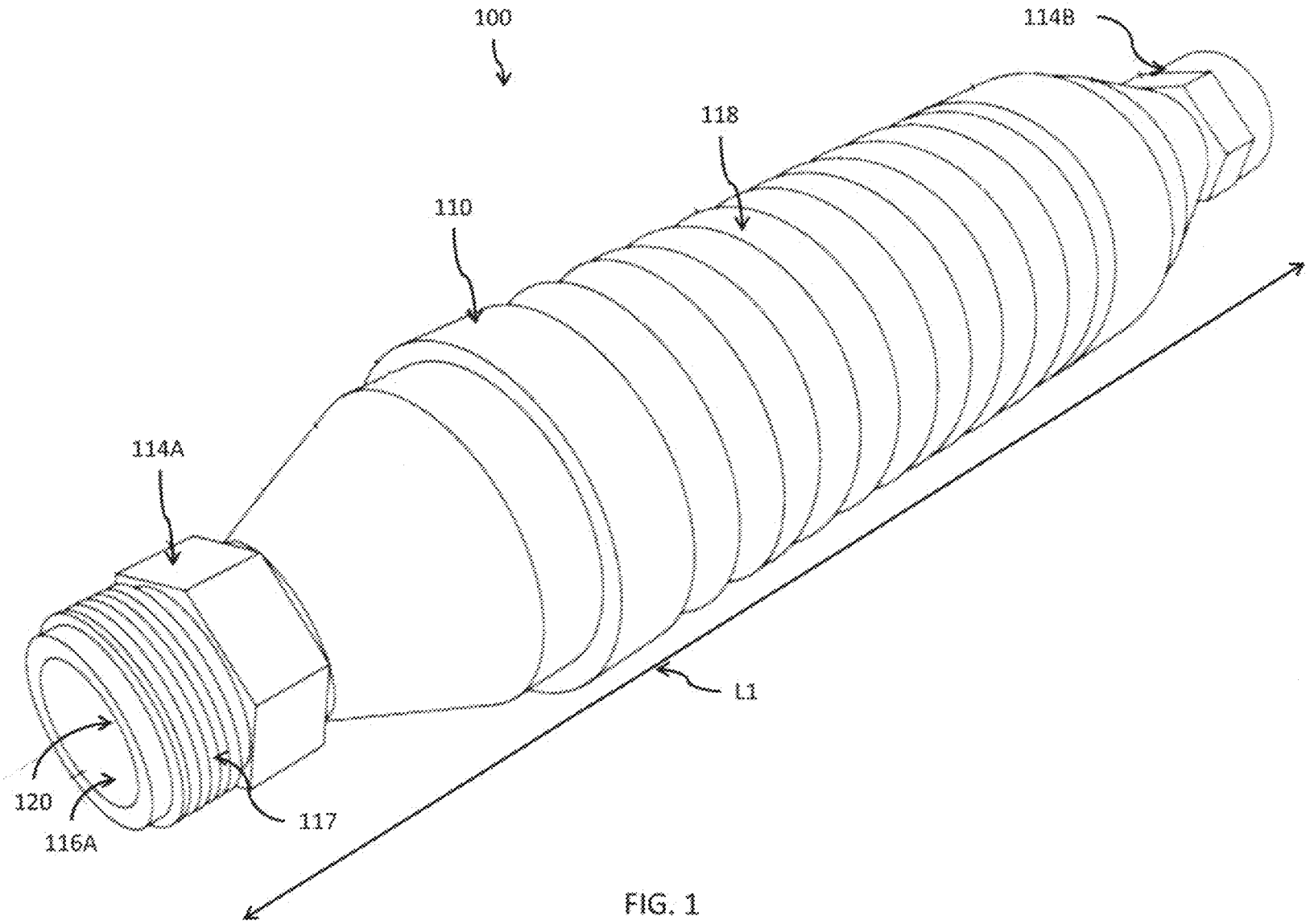
FIG. 1 is a perspective view of an apparatus for efficiently burning hydrocarbons in accordance with aspects of the invention.

Aspects of the invention are directed to apparatuses for efficiently burning fuels. Suitable fuels include, but are not limited to liquid and/or gaseous fuels such as hydrocarbons, petroleum oil and its derivatives, natural gas, propane, gasoline, alcohols, ethanol mixtures, cooking oils, etc. Such apparatuses may be coupled to fuel lines for systems that utilize the energy produced by combusting such fuel. For example, the apparatuses disclosed herein may be coupled upstream from combustion engines for vehicles, stove burners, water heaters or boilers, combustion chambers, etc.

Generally, it is an aim of the invention to provide apparatuses, systems, and methods for efficiently burning fuel (e.g. gaseous or liquid hydrocarbons) for cooking, heating, manufacturing, transportation, or other purposes. Other potential fuels for use with aspects of the invention include, but are not limited to, alcohols, ethanol mixtures, cooking oils, etc. Advantages achieved by aspects of the invention may include inexpensive manufacture, ease of install, and multiple purposes in commercial and residential settings. Aspects of the invention may also be used for applications of varying scope, including residential applications, such as single furnaces (small); industrial applications, such as glass blowers (large); and transportation applications, such as for improving the fuel efficiency of cars, trucks, cargo ships, cruise lines, etc. Table 1, provided below, illustrates the extensive use of natural gas in the United States.

TABLE 1

| | | |
|---|---|---|
| Total US Natural Gas Use | 26.7 Tcf: | 100% |
| PowerGen | 8.15 Tcf | 31% |
| Industrial | 7.62 Tcf | 29% |
| Residential | 5.09 Tcf | 19% |
| Commercial | 3.47 Tcf | 13% |
| Lease/Plant fuel | 1.50 Tcf | 6% |
| Pipeline/Distribution | 0.84 Tcf | 3% |
| Vehicle Fuel | 0.04 Tcf | 0.1% |

Accordingly, aspects of the invention can provide significant improvements to the reduction of green house gas production while providing significant cost savings.

In accordance with one aspect of the invention, an apparatus is designed to be simple and elegant, having a compact size, with a closed off magnetic field, which provides optimal effect on hydrocarbons and does not create wave interference to electronic devices nearby. The body frame may be made of non-explosive materials/non-flammable (e.g., metal) to prevent explosions. The apparatus may be designed for installation by a user at a gas meter, at an inlet of a natural gas unit, or at other suitable locations.

The magnetic field(s) may be created inside a housing carrying the fuel flow to disassociate the individual molecules of the fuel. The magnetic field of the magnets activates and disjoins fuel (e.g., natural gas) clusters into molecules as the fuel flows through the housing, promoting more efficient burning of the fuel. The magnetic field(s) may be created inside a housing carrying the fuel flow to disassociate the individual molecules of the fuel. The magnetic field of the magnets activates and disjoins fuel (e.g., natural gas) clusters into molecules as the fuel flows through the housing, promoting more efficient burning of the fuel.

Increasing the power of the magnet increases the burning efficiency up to the point where the molecules of the fuel are perfectly aligned (e.g., in the direction of the flow). In addition, the magnetic energy applied to the fuel should increase as the flow rate of the fuel increases to maintain a desired fuel burning efficiency. The energy content of the magnet(s) may be determined using the following equation, $$W_m = nV_m B^2/2\mu_0$$

Where $W_m$ is the power of the magnet, J; n is the number of magnets; $V_m$ is the volume of the magnet, $m^3$; B—magnet's magnetic field induction, Tesla; $\mu_0$ is the magnetic constant, $\mu_0 = 1.25663706 \times 10^{-6}$ N/A$^2$.

Without being limited to any one theory, the inventors believe that magnetic fields increase the efficiency of fuel combustion by overcoming intermolecular forces, such as van der Waals forces (10-20 kJ/mol). It varies depending on the initial parameters, mainly on the temperature, pressure. With the weakening or overcoming of intermolecular bonds, each molecule will react separately with oxygen (during oxidation).

Van der Waals forces may be calculated for non-ideal gas (or for real gas) using the following equation, $$\left(P + \frac{n^2 a}{V^2}\right)(V - nb) = nRT$$

where V refers to the volume of gas; n refers the moles of gas; a is a specific value of a particular gas; P represents the pressure measured; b expresses the eliminated volume per mole, which accounts for the volume of gas molecules and is also a value of a particular gas; R is a known constant, 0.08206 L atm mol$^{-1}$ K$^{-1}$; and T refers for temperature.

A catalyst (e.g., platinum and/or palladium catalyst film) may also be used. The catalyst may be applied to a surface proximal to the burner adapted for the burning such fuels. For example, a catalyst layer may be applied to an inner surface of the housing and/or to the surface of the magnetic balls. Additionally or alternatively, the apparatus for efficiently burning hydrocarbons may be positioned as close as possible to the burner to improve the combustion efficiency. The preferred thickness of the catalyst film is between one and three microns, but the thickness may be varied as desired by those skilled in the art without deviating from the scope and spirit of the invention.

FIG. 1 illustrates a non-limiting embodiment of an apparatus 100 for efficiently burning hydrocarbons according to aspects of the invention. As a general overview, apparatus 100 includes a housing 110 defining a passageway 120 and a plurality of magnets 130 (See FIG. 2) residing within passageway 120.

Housing 110 has a first opening 116A adjacent a first end of passageway 120 for receiving a fuel and a second opening 116B adjacent a second end of passageway 120 for expelling the fuel after it has passed through passageway 120. First opening 116A may be formed in a first end portion 114A of housing 110, while second opening 116B may be formed in a second end portion 114B of housing 110. First end portion 114A may be connected to second end portion 114B by middle portion 118. First and/or second end portions 114 may be coupled to a pipe for receiving and expelling the fuel. In the embodiment illustrated in FIG. 1, first and/or second end portions 114 have threads 117 for attaching apparatus 100 to, e.g., a pipe containing fuel flow.

Housing 110 also has an inner surface 122 (see FIG. 3A) defining passageway 120, which extends between first opening 116A and a second opening 116B. Although passageway 120 is depicted as having a length L2 (see FIG. 2) substantially equal to length L1 of housing 110, in at least one embodiment, housing 110 may be configured such that passageway 120 has a length L2 that is greater than length L1 of housing 110. For example, inner surface 122 of housing 110 may be configured to define passageway 120 having bends and/or turns to increase the length L2 of passageway 110 to be greater than length L1 of housing 110. Additionally and/or alternatively, inner surface 122 may be configured such that passageway 120 has a cross-sectional shape that is geometric, e.g., tubular, rectangular, etc., or has a non-geometric shape. Preferably, housing 110 has an inner surface 122 that has protrusions and/or detents that produce desirable movement of the fuel, e.g., turbulent flow. For example, inner surface 122 may have protrusions and/or detents in the form of ribs, ridges, bumps, grooves, indents, etc. In one embodiment, inner surface 122 is configured such that passageway 120 has a substantially de Laval shape. The distance the protrusion and/or detent of inner surface 122 extends may be 20% or less of the diameter 128 (see FIG. 3B) of passageway 120.

As housing 110 contains a plurality of magnets 130 within passageway 120, which is further discussed below, housing 110 may be formed of a material or may include a layer of a material that shields surrounding items/objects from the ferromagnetic field produced by plurality of magnets 130. Suitable materials for housing 110 or a layer of housing 110 include magnetic materials, such as copper, nickel, steel, and the like, as well as alloys thereof. In one embodiment, apparatus 100 includes a discrete layer and/or material that acts as a Faraday cage by preventing magnetic fields from passing through such layer. Housing 110 may be corrugated to allow housing 110 to bend, which facilitates attachment of apparatus 100 to fuel lines. A cover, such as a cylinder, may be positioned to substantially surround housing 110.

Figure 2:
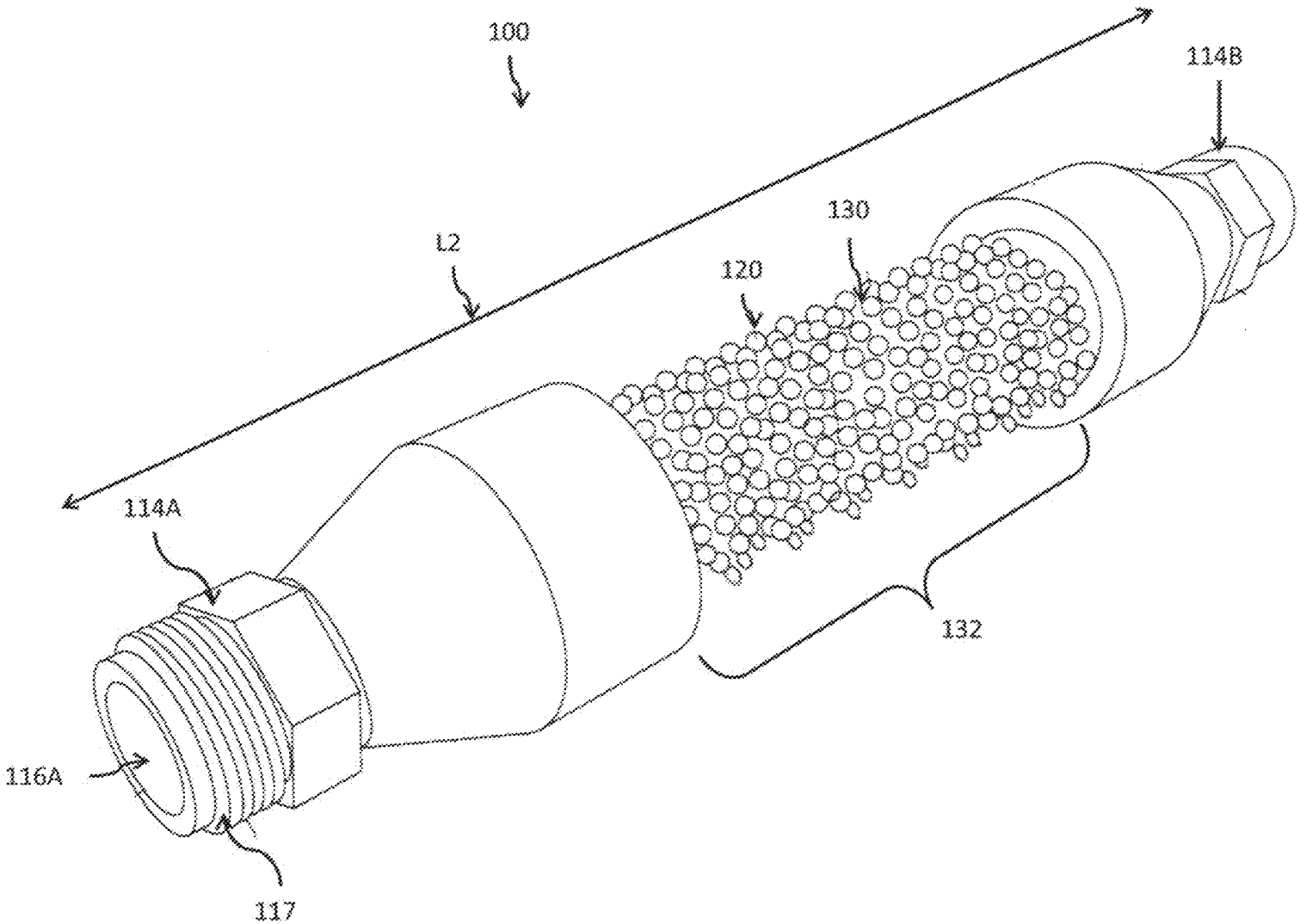
FIG. 2 is a perspective view of the apparatus of FIG. 1 having a transparent housing.
Figure 3B:
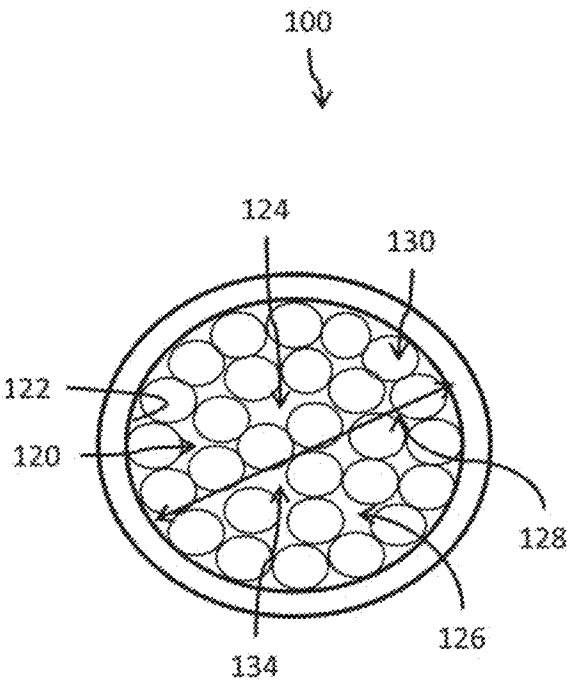
FIGS. 3A and 3B are cross-sectional views of the apparatus of FIG. 1.
Figure 3A:
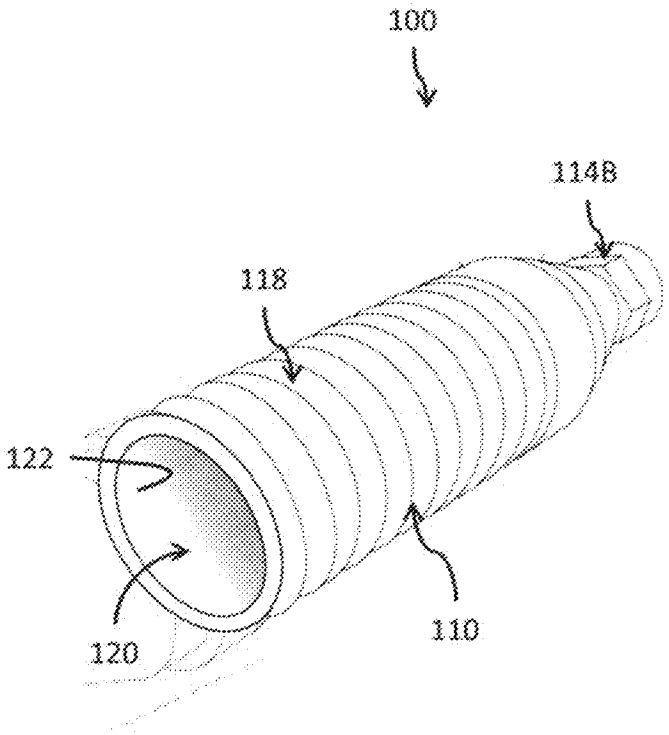

FIG. 2 illustrates a plurality of magnets 130 disposed within passageway 120 of housing 110. The plurality of magnets 130 may be retained within a magnet chamber 132 that extends within a middle portion 118 of housing 110, e.g., extending from first end portion 114A to second end portion 114B. In one embodiment, a mesh material made of, e.g., metals, ceramics, catalysts, etc., is disposed within passageway 120 at each end of magnet chamber 132, such that the plurality of magnets 130 are retained within magnet chamber 132 while the fuel is able to flow therethrough. One of ordinary skill in the art would readily recognize that structures and/or materials other than a mesh material that may be used to retain the plurality of magnets 130 within magnet chamber 132 without departing from the scope and/or spirit of the invention.

As illustrated in FIG. 2, the plurality of magnets 130 may be free floating within passageway 120 and/or magnet chamber 132. As used herein, the term free floating refers to the magnets not being physically or chemically restrained within the magnetic chamber. The plurality of magnets 130 may be free floating within passageway 120 and/or magnet chamber 132 even where plurality of magnets 130 does not readily move after positioning magnets 130 within magnet passageway 120 and/or magnet chamber 132.

Housing 110 may be configured such that the fuel passes through a plurality of different zones that subject the fuel to varying magnetic forces. For example, the fuel may be subjected to stronger magnetic forces when the fuel passes closer to a magnet and/or when the fuel passes through a zone having stronger magnets and/or more magnets (e.g., corrugated portions of the housing 110 may facilitate the fuel flowing through a zone with less surrounding magnets 130). With spherical or ovoid magnets 130, the induction may be the largest at the poles and the smallest at the equatorial part of the magnet 130. Therefore, as the fuel passes near the surface of a spherical or ovoid magnet 130, the fuel is subjected to varying strengths of the magnetic field as the fuel moves closer to or farther away from the poles and/or equatorial part of the magnet 130. Additionally or alternatively, the fuel molecules may rotate as they move through the passageway 120 of housing 110 due to their magnetic moment. As the fuel is subjected to vary strengths of the magnetic field, the binding energy of electrons with atoms and molecules may decrease, thereby further reducing the activation energy required to combust the fuel.

The plurality of magnets 130 may be permanent magnets, such as ceramic magnets, alnico magnets, rare earth magnets, etc. In one embodiment, the plurality of magnets 130 include at least one of samarium cobalt magnets and neodymium iron boron magnets. In another embodiment, the plurality of magnets 130 includes structures formed of magnetic particles or composite magnets. In yet a further embodiment, each of the plurality of magnets is a neodymium iron boron magnet. The plurality of magnets 130 may include any suitable magnet and/or electromagnet, which would be understood by one of skill in the art from the descriptions herein.

The plurality of magnets 130 may each have a geometric shape, such as a sphere, an ovoid, etc. The plurality of magnets 130 may include a first set of magnets having a first size and a first shape, and a second set of magnets having a second size and second shape that is different from the first size and/or first shape of the first set of magnets. In one embodiment, each of the plurality of magnets 130 is a sphere having the same dimensions and/or radius. In another embodiment, the plurality of magnets includes spheres having two or more different radiuses, e.g., spheres having a radius of a first length or a radius of a second length. The plurality of magnets 130 may be selected such that a first set of smaller magnets are configured to reside in the void space defined by the second set of larger magnets. Although not particularly limited to any specific size, the plurality of magnets 130 preferably have a radius of 10 cm or less, more preferably 8 cm or less, more preferably 6 cm or less, more preferably 4 cm or less, more preferably 3 cm or less, more preferably, 2 cm or less, more preferably 1 cm or less when the plurality of magnets 130 are spherical.

The plurality of magnets 130 define void spaces 134 between the plurality of magnets 130 and between the plurality of magnets 130 and housing 110. An equation for assessing/determining the void space over a cross-sectional area for a set of magnets having the same radius is provided below:

$$S_{void\ space}=S_{pipe}-S_{spheres}=\Pi\cdot(r^2_{pipe}-n\cdot r^2_{spheres})$$

Fuel passes through the void spaces 134 when flowing through magnet chamber 132 of passageway 120. As mentioned above, inner surface 122 defining passageway 120 may have protrusions (e.g., associated with corrugation of housing 110) and/or indents. The protrusions and/or indents of inner surface 122 may affect the flow regime of the fuel. For example, ribs or protrusions associated with corrugation of housing 110 may produce turbulent fuel flow in at least an outer region 126 proximal to inner surface 122. In one embodiment, the outer region 126 includes a volume equivalent (i.e., within 10%) to a volume of a central region 124 of passageway 120. Turbulent fuel flow may increase the velocity of fuel molecules and, thus, may increase the activation and/or declustering of hydrocarbons in the fuel. In one embodiment, the fuel flowing through void spaces 134 in an outer region 126 of passageway 120 has a turbulent flow, while the fuel flowing through void spaces 134 in a central region 124 of the passageway 120 has a laminar flow. In a more specific embodiment, passageway 120 forms a cylindrical tube defined by inner surface 120 with ridges that create turbulent flow in the outer region 126, while laminar flow is maintained in the central region 124 of passageway 120.

In one embodiment, the volumetric flow of the fuel is uniform over a cross-sectional area of passageway 120 through void spaces 134 defined by plurality of magnets 130 in at least the central region 124 of passageway 120. In one embodiment, the volumetric flow of fuel through void spaces 134 is uniform over a cross-section area of passageway 120. For example, the volumetric flow rate of the fuel passing through void spaces 134 in a central region 124 of the passageway 120 may be equivalent (i.e., within 10%) to the volumetric flow rate of the fuel passing through void spaces 134 in an outer region 126 of passageway 120.

The dimensions of housing 110 and the plurality of magnets may be configured to obtain desirable flow properties. For example, apparatus 100 may be configured such that a cross-sectional area of first opening 116A and/or a cross-sectional area of second opening 1163 is substantially equivalent to an area of void spaces 134, defined by the plurality of magnets 130, over a cross-sectional area of passageway 120. In one embodiment, the area of void spaces 134 over a cross-sectional area of passageway 120 is substantially equivalent to the cross-sectional area of first opening 116A and the cross-sectional area of second opening 116B, such that a pressure drop between first opening 116A and second opening 116B is minimal (e.g., less than 1 Pascal). Additionally and/or alternatively, the cross-sectional area of second opening 116B may be slightly larger than the cross-sectional area of first opening 116A so that the fuel, which takes up more volume after flowing through the passageway 120, flows at a consistent speed and/or under a consistent pressure. In another embodiment, the cross-sectional area of second opening 116B is smaller than an area of void spaces 134 over a cross sectional area of passageway 120 (e.g., see FIGS. 4-6), which may increase the velocity of the fuel leaving apparatus 100 for combustion.

The inventors have discovered that apparatuses in accordance with various aspects of the invention provided surprisingly improved combustion efficiencies. For example, by employing a plurality of magnets 130 each of the same size and having a spherical shape, a uniform volumetric fuel flow across the cross section of passageway 120 may be achieved as the void spaces 134 between each of the magnets are substantially equally and/or equal in size. Without being bound by any theory, it is believed that spherical magnets produce advantageous results because the void spaces defined between a plurality of spherical magnets do not significantly vary and the rearmament or rotation of the individual magnets does not significant affect the uniformity of the void spaces. Accordingly, the inventors discovered that uniform void spaces 134 across a cross-sectional area of passageway 120 may be obtained without positionally affixing the plurality of magnets 130 within magnet chamber 132 (e.g., allowing plurality of magnets 130 to be free floating within magnet chamber 132), which is highly advantageous because affixing the magnets 130 to inner surface 112 drastically increase costs, is difficult for unskilled workers, prevents easy replacement of magnets, and particularly hinders/prevents uniform volumetric flow of fuel through the void spaces 134. Additionally and/or alternatively, apparatus 100 may be configured such that all the fuel molecules are within 5 mm of at least one magnet 130 while passing through magnet chamber 132 of housing 110. For example, apparatus 100 may be configured such that all of the fuel within magnet chamber 132 of passageway 120 is within 4 mm, preferably within 3 mm, preferably within 2 mm, preferably within 1 mm (all end points being inclusive) of at least one magnet 130.

Figure 4:
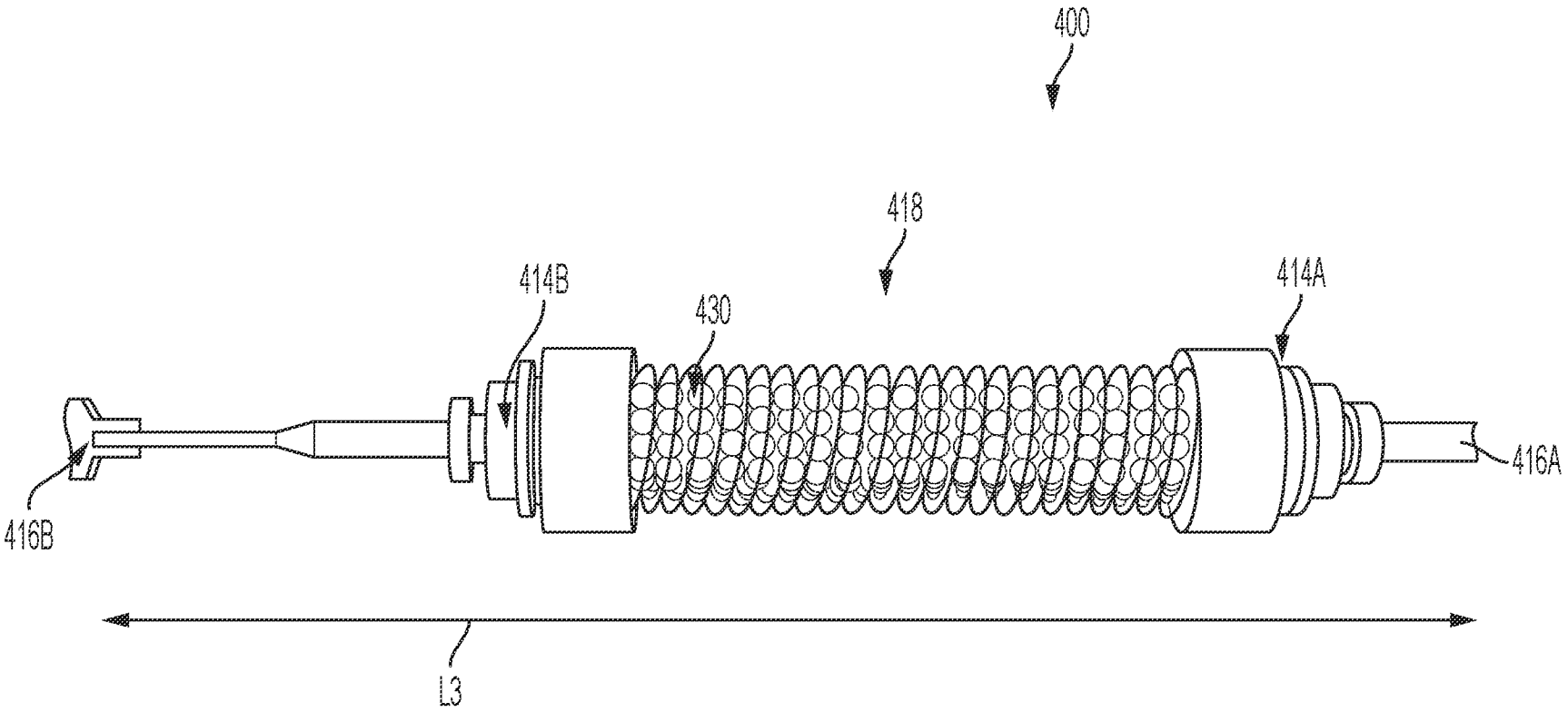
FIG. 4 is a side view of another apparatus, with a partially transparent housing, for efficiently burning hydrocarbons according to aspects of the invention.
Figure 5A:
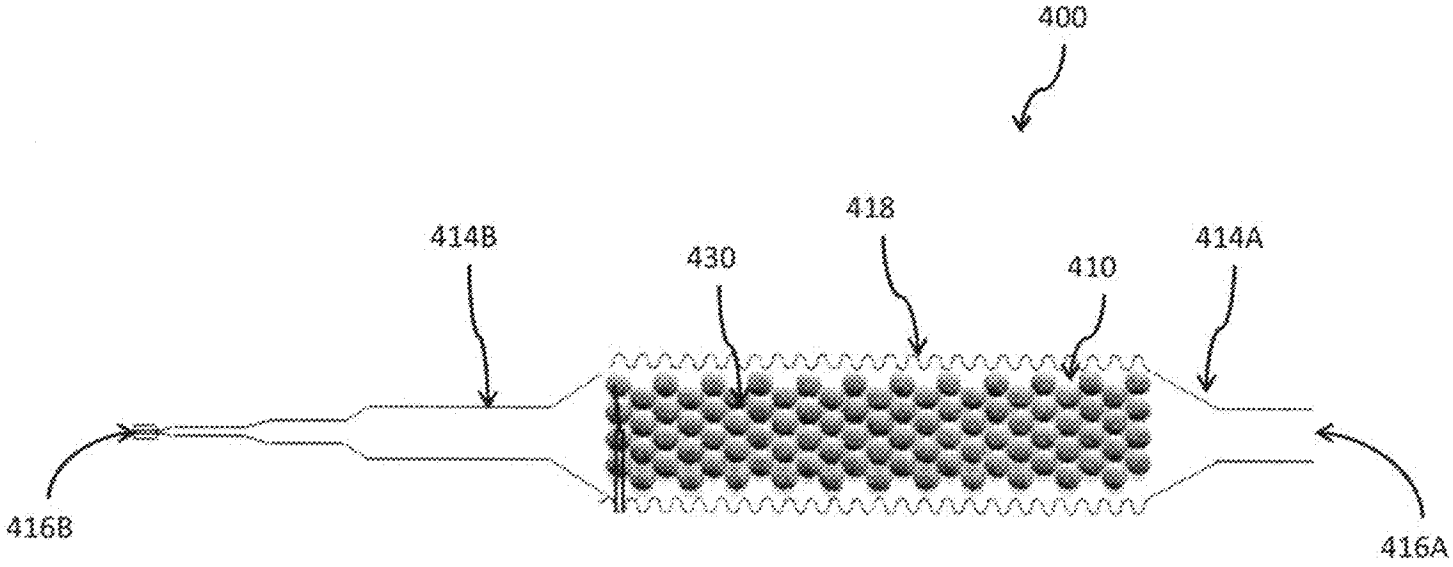
FIG. 5A is a cross-sectional view along the length of the apparatus of FIG. 4.
Figure 5B:
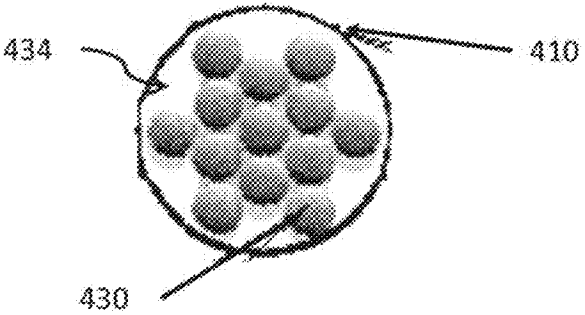
FIG. 5B is a cross-sectional view that traverses the length of the apparatus of FIG. 4 in the middle section of the housing.

FIGS. 4-5B illustrate another non-limiting embodiment of an apparatus 400 for efficiently burning hydrocarbons according to aspects of the invention. Apparatus 400 includes features that are similar to those discussed above with respect to apparatus 100. Additional details regarding apparatus 400 are omitted in the following discussions and FIGS. 4-5B, where unnecessary due to the prior discussion of similar elements in order to avoid duplication. As a general overview, apparatus 400 includes a housing 410 defining a passageway 420 and a plurality of magnets 430 residing within passageway 420.

Housing 410 has a first opening 416A adjacent a first end of passageway 420 for receiving a fuel and a second opening 416B adjacent a second end of passageway 420 for expelling the fuel after it has passed through passageway 420. First opening 416A may be formed in a first end portion 414A of housing 410 and spaced by a length L3 from second opening 416B, which is formed in a second end portion 414B of housing 410. First end portion 414A may be connected to second end portion 414B by middle portion 418. As shown by the embodiment illustrated in FIGS. 4-5B, second opening 416B may be smaller than first opening 416A and/or void spaces 434 between the plurality of magnets 430 and between the plurality of magnets 430 and housing 410 to, e.g., increase the velocity of the fuel leaving apparatus 400.

Figure 6:
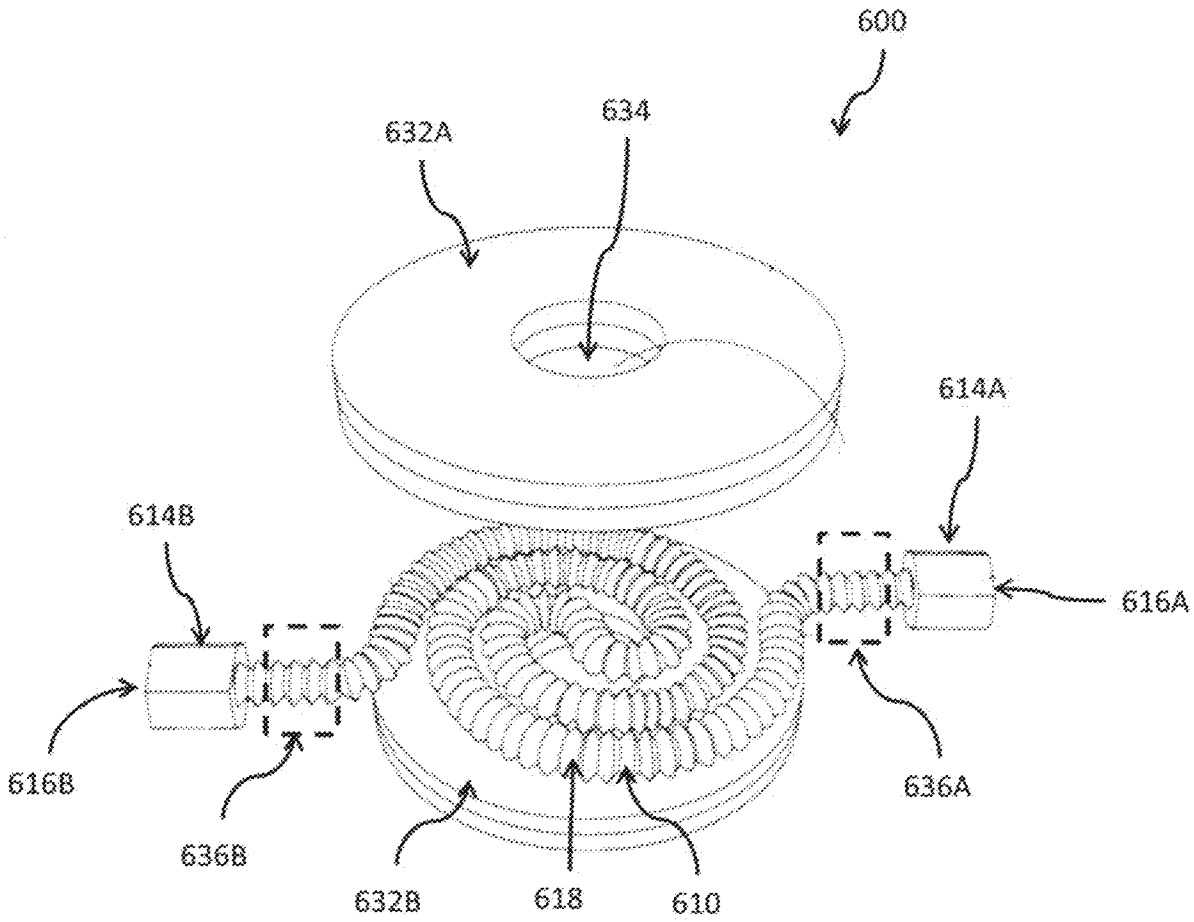
FIG. 6 is a perspective view of a further apparatus for efficiently burning hydrocarbons in accordance with aspects of the invention.

FIG. 6 is a perspective view of a further apparatus for efficiently burning hydrocarbons in accordance with aspects of the invention. Apparatus 600 also includes features that are similar to those discussed above with respect to apparatuses 100 and 400, with details regarding those features omitted in order to avoid duplication. As a general overview, apparatus 600 includes a housing 610 defining a passageway (not shown) and at least two magnets 632.

Housing 610 defines a passageway extending from a first opening 616A configured for receiving a fuel to a second opening 6165 configured for expelling the fuel. First opening 616A may be formed in a first end portion 614A of housing 610 and second opening 6165 may be formed in a second end portion 614B of housing 610. First end portion 614A may be connected to second end portion 4145 by middle portion 618 of housing 610.

The passageway may include one or more magnet chamber sections 636 that extend within the middle portion 618 of housing 610. In the embodiment illustrated in FIG. 6, a first magnet chamber sections 636A is located proximal to first end portion 614A of housing 610 and a second magnet chamber sections 636B is located proximal to second end portion 614B of housing 610. In an alternative embodiment, first end portion 114A and/or second end portion 114B of housing 110 includes a magnet chamber sections 636. The plurality of magnets may be retained within the first and/or second magnet chamber sections 636A and/or 636B by way of a mesh material made of, e.g., metals, ceramics, catalysts, etc., such that the plurality of magnets are retained within magnet chambers 636A and/or 636B while the fuel is able to flow therethrough. One of ordinary skill in the art would readily recognize that structures and/or materials other than a mesh material may be used to retain the plurality of magnets within magnet chambers 636A and 636B without departing from the scope and/or spirit of the invention.

As illustrated in FIG. 6, first magnetic plate 632A is positioned proximal to a first side of housing 610, while second magnetic plate 632B is positioned opposite first magnetic plate 632A and proximal to a second side of housing 610. First magnetic 632A and/or second magnetic 632B may include an aperture 634 extending from a first surface of first and/or second magnetic 632 to the opposed surface of the first and/or second magnetic 632. Although not illustrated in FIGS. 1-5B, magnetic plates 632 may be employed with various aspects of the invention, including apparatuses 100 and 400.

Although the invention is illustrated and described herein with reference to specific embodiments, the invention is not intended to be limited to the details shown. Rather, various modifications may be made in the details within the scope and range of equivalents of the claims and without departing from the invention.

EXAMPLE

The following example is a non-limiting embodiment of the invention, included herein to demonstrate the advantageous utility obtained from aspects of the invention.

An apparatus for efficiently burning fuels in accordance with the teachings of FIGS. 1-3 and related description was connected to a stove burner and tested in comparison to the same stove burner without the apparatus for efficiently burning fuels. The apparatus had a length of 5 inches and a passageway with a diameter of 0.7 inches. The inlet of the apparatus had a diameter of 0.24 inches and the outlet had a diameter of 0.3 inches. 216 magnets were deposed within the passageway of the apparatus. Each of the magnets was spherical and had a radius of about 0.2 inches.

In a first test, a pot containing 8 fl. oz. of water was heated using a stove burner without the apparatus for efficiently burning fuels. The fuel flow to the burner was held constant. The temperature of the water rose from an initial temperature of 16.5° C. to a final temperature of 66.5° C. in 304 seconds.

In a second test, the same pot was used to heat 8 fl. oz. of water using the same stove burner with the apparatus for efficiently burning fuels coupled to the fuel line upstream of the stove burner. The fuel flow to the burner was held constant at approximately the same rate as used to heat the water in the first test. The temperature of the water rose from an initial temperature of 17.7° C. to a final temperature of 69° C. in 183 seconds.

Therefore, the apparatus for efficiently burning fuels reduced the time for heating the water about 50° C. by about 39.8%. Because the fuel flow to the stove burner was held approximately constant between the first and second tests, the reduction in the amount of time to heat the water about 50° C. is equivalent to the increased efficiency provided by the apparatus for efficiently burning fuels.

What is claimed is:

1. An apparatus for efficiently burning hydrocarbons comprising:

a housing having a first opening for receiving a fuel, a second opening for expelling the fuel, and a tubular passageway extending between the first opening and the second opening, the tubular passageway including a central region and an outer region surrounding the central region;

a plurality of magnets disposed within the passageway, each of the magnets having one of a spherical or an ovoid shape, wherein the plurality of magnets define void spaces for passing the fuel such that a central flow rate of the fuel in the central region of the passageway is equivalent to the an outer flow rate of the fuel in an outer region of the passageway, wherein the tubular passageway includes a cylindrical tube defined by an inner surface with ridges that create turbulent fuel flow in the outer region while laminar fuel flow is maintained in the central region, and wherein a cross-sectional area of the first opening is substantially equivalent to an area of the void spaces in a cross-sectional area of the passageway.

2. The apparatus of claim 1, wherein the plurality of magnets are positioned such that all of the fuel within the passageway is within 2 mm of at least one of the plurality of magnets.

3. The apparatus of claim 1, the central flow rate is uniform over a cross-sectional area of the passageway through void spaces defined by the plurality of magnets in at least the central region of the passageway.

4. The apparatus of claim 1, wherein the plurality of magnets are free floating within the passageway.

5. The apparatus of claim 1, wherein the plurality of magnets are spherical and the void spaces in a cross-sectional area of the passageway are determined according to the following equation:

$$S_{void\ space}=\Pi\cdot(r^2_{pipe}-n\cdot r^2_{spheres})$$

wherein $r_{pipe}$ is the radius of the passageway, $r_{spheres}$ is the radius of the magnets, n is the number of magnets.

6. An apparatus for efficiently burning hydrocarbons comprising:

a housing having a first opening for receiving a fuel, a second opening for expelling the fuel, and a tubular passageway extending between the first opening and the second opening, the tubular passageway including a central region and an outer region surrounding the central region;

a plurality of magnets disposed within the passageway, each of the magnets having one of a spherical or an ovoid shape, wherein the plurality of magnets define void spaces for passing the fuel such that a central flow rate of the fuel in the central region of the passageway is equivalent to the an outer flow rate of the fuel in an outer region of the passageway, wherein the tubular passageway includes a cylindrical tube defined by an inner surface with ridges that create turbulent fuel flow in the outer region while laminar fuel flow is maintained in the central region, and wherein a cross-sectional area of the second opening is substantially equivalent to an area of the void spaces in a cross-sectional area of the passageway.

7. An apparatus for efficiently burning hydrocarbons comprising:

a housing having a first opening for receiving a fuel, a second opening for expelling the fuel, and a tubular passageway extending between the first opening and the second opening, the tubular passageway including a central region and an outer region surrounding the central region;

a plurality of magnets disposed within the passageway, each of the magnets having one of a spherical or an ovoid shape, wherein the plurality of magnets define void spaces for passing the fuel such that a central flow rate of the fuel in the central region of the passageway is equivalent to the an outer flow rate of the fuel in an outer region of the passageway, wherein the tubular passageway includes a cylindrical tube defined by an inner surface with ridges that create turbulent fuel flow in the outer region while laminar fuel flow is maintained in the central region, and wherein a cross-sectional area of the second opening is smaller than an area of the void spaces in a cross-sectional area of the passageway.

8. An apparatus for efficiently burning hydrocarbons comprising:

a housing having a first opening for receiving a fuel, a second opening for expelling the fuel, and a tubular passageway extending between the first opening and the second opening, the tubular passageway including a central region and an outer region surrounding the central region;

a plurality of magnets disposed within the passageway, each of the magnets having one of a spherical or an ovoid shape, wherein the plurality of magnets define void spaces for passing the fuel such that a central flow rate of the fuel in the central region of the passageway is equivalent to the an outer flow rate of the fuel in an outer region of the passageway, wherein the plurality of magnets comprises a first set of magnets having a first size and a second set of magnets having a second size, the second size of the second set of magnets being different from the first size of the first set of magnets.

9. The apparatus of claim 8, wherein the second set of magnets is configured to reside in the void space defined by the first set of magnets.

* * * * *